US005575119A

United States Patent [19]

Wolfowitz

[11] Patent Number: 5,575,119

[45] Date of Patent: Nov. 19, 1996

[54] BUILDING ELEMENT

[76] Inventor: Steven A. Wolfowitz, 106 Terrace Road, Sebenza, Edenvale, Johannesburg, South Africa

[21] Appl. No.: 251,423

[22] Filed: May 31, 1994

[30] Foreign Application Priority Data

May 29, 1993 [ZA] South Africa ..... 93/3746
Aug. 25, 1993 [ZA] South Africa ..... 93/6213

[51] Int. Cl.[6] ..... E04H 1/02

[52] U.S. Cl. ..... 52/79.1; 52/79.2; 52/79.5; 52/271; 52/309.1

[58] Field of Search ..... 52/79.1, 79.2, 52/79.3, 79.5, 589.1, 590.1, 590.2, 79.7, 586.1, 586.2, 271, 272, 592.6, 309.1, 439, 424, 425, 592.2, 592.5

[56] References Cited

U.S. PATENT DOCUMENTS 3,564,795 2/1971 Henton ..... 52/79.2
3,788,020 1/1974 Gregori ..... 52/439 X
4,038,798 8/1977 Sachs ..... 52/309.7
4,706,429 11/1987 Young ..... 52/309.12

*Primary Examiner*—Kien T. Nguyen
*Attorney, Agent, or Firm*—Young & Thompson

[57] ABSTRACT

A building element comprises a topless and bottomless box, preferably manufactured in two halves which are joined together about the vertical diagonal. The top or bottom of the box includes a channel formation which engages the periphery of an adjacent element when stacked therewith. The elements may be stacked to overlap two similar elements located below it and once electrical, water and other service conduits have been placed in position, a concrete mixture or mud or the like is used to fill the boxes. This results in a sturdy structure that is inexpensive and which requires no maintenance or finishing.

9 Claims, 5 Drawing Sheets

BUILDING ELEMENT

FIELD OF THE INVENTION

This invention relates to a building element which is particularly useful in the rapid erection of low cost housing.

BACKGROUND OF THE INVENTION

The majority of schemes for low cost housing have centered around the provision of interlocking building blocks but these have to be transported to the site or made on the site with moulds which have to be transported.

Moulded building blocks are not inexpensive and require a degree of skill to erect them. They also have to be finished off by plastering, painting, or the like, and require maintenance.

It has also been proposed to effect low cost housing by forming cladding or shuttering or formwork into which concrete is poured but these methods often involve the elevation of heavy concrete to the top of such shuttering. When the shuttering is removed, it is necessary to finish off the structure as discussed above.

It is an object of the present invention to provide an element for a building procedure which allows unskilled persons to erect an inexpensive house or other building very rapidly and for the resulting building not to require finishing or maintenance.

THE INVENTION

According to the invention a building element comprises a pair of right-angled elements interengageable to form a topless and bottomless box, upper or lower edges of the box including a channel formation adapted to receive the periphery of an adjacent element in stacking relationship, the outer walls of the channel being continuous and the inner wall including a series of castellations, that is, cutouts, adapted to receive the peripheries of building elements.

In the preferred form of the invention the right angled elements are L-shaped.

It will be appreciated that the interengaging formations may take a variety of forms, such as dovetail, tenon and mortice and many other however, in the preferred form, the right angled elements include formations at the ends thereof which are slidable into and out of engagement in a horizontal plane, the main object being to provide interengaging joints which are slidable in and out of engagement in the vertical plane or otherwise easily locatable.

In the preferred form of the invention the interengaging means for the L-shaped elements comprise flexible male elements having hooked free ends engageable in complemental female elements including formations adapted to accept the hooked ends.

The male elements may take the form of tongues or spades with straight sided hooked ends providing suitable shoulders for engaging in complemental formations in the female element.

In one preferred form of the invention a series of male elements may be provided at one end of a right angle portion of a box and complemental female elements at the other end, so that a pair of right angled portions may be joined together by mating the corresponding male and female elements.

In an alternative form of the invention, the interengaging means comprise ball and socket joints which may be included in the mould.

The invention makes it possible also to include longitudinally disposed horizontal reinforcing ribs or the like and the interengaging formations may be located at the ends of the horizontal reinforcing ribs.

Cutouts may also be included in the building elements of the present invention for the purpose of saving material and also to provide a degree of deformation which may be necessary in certain circumstances. The primary purpose of the cutouts is to provide a passage through the building elements for electrical conduits, water pipes and the like. This eliminates the unsightly practice of having conduits and pipes running along the surfaces of the walls. Drainage pipes, for example, may even be located at an angle to improve the efficiency of the drainage system. The cutouts may be triangular or rectangular for example.

An important aspect of the invention is the provision of nicks at the corners of the channelled periphery which permits the staggering of adjacent elements.

In a further modification of the invention of the peripheral channels comprise a continuous outer wall and an inner wall interrupted by castellations at predetermined locations for receiving the edges of building elements. This facilitates the staggered stacking of the building elements for example with a quarter or half length thereof overlapping and bonding with the adjacent element. In this staggered position the elements are held firm in the channel of the elements located therebelow and cannot slide out. It is also conceivable that the castellations could receive edges of building elements at right angles thereto and bond with them, although this would of necessity involve the removal of a corresponding castellation from the outer wall of the channel.

It should further be noted that castellations are of sufficient width to accommodate closely, two edges of adjacent elements. The castellations further aid in adding strength to the structure being built when the building elements are staggered for example in the half-overlap formation. The periphery male formation of the top or overlapping building element fits closely against the inner sides of the respective castellations. This prevents the sliding out of the two underlying building elements in either direction. Thus the top building element effectively bonds the two elements therebelow, together; or vice versa.

In yet a further modification, the peripheral channel may taper inwardly the periphery of the opposite edge being complementally tapered. The channel and the opposite periphery both being off set from the wall of the unit to provide a straight sided wall.

The building elements are preferably injection moulded from a suitable plastic material and acrylonitrile/butadiene/styrene polymers as well as polyvinyl chloride have been found to be very suitable for the purpose as they are and can be rendered relatively non-inflammable, have a good appearance and can be made strong enough, even for an inexpensive element to bear a load. They can also be rendered UV resistant.

Once the element of the invention has been assembled to the plan required, services such as electrical conduits, water pipes and the like may be located, followed, if required, by reinforcing rods and then a concrete mixture, or mud or any other suitable mixture poured to complete the building operation, the boxes remaining in position to provide an excellent outside appearance which requires neither any further finishing or, indeed, any maintenance. The resulting structure can be adapted to provide for windows and doors and is strong enough to support a conventional roof. Load bearing posts may be included in the structure connecting and supporting beams to support conventional building systems.

The building elements may be provided with vertical formations such as ridges, gutters, corrugations or the like to constitute channels to conduct water downwardly during rain storms, floods and the like. The operation of building may be commenced by laying a slab or a foundation with the boxes then being laid on such slab or foundation.

EMBODIMENTS OF THE INVENTION

Embodiments of the invention are described below with the reference to the accompanying drawings in which.

Figure 1:
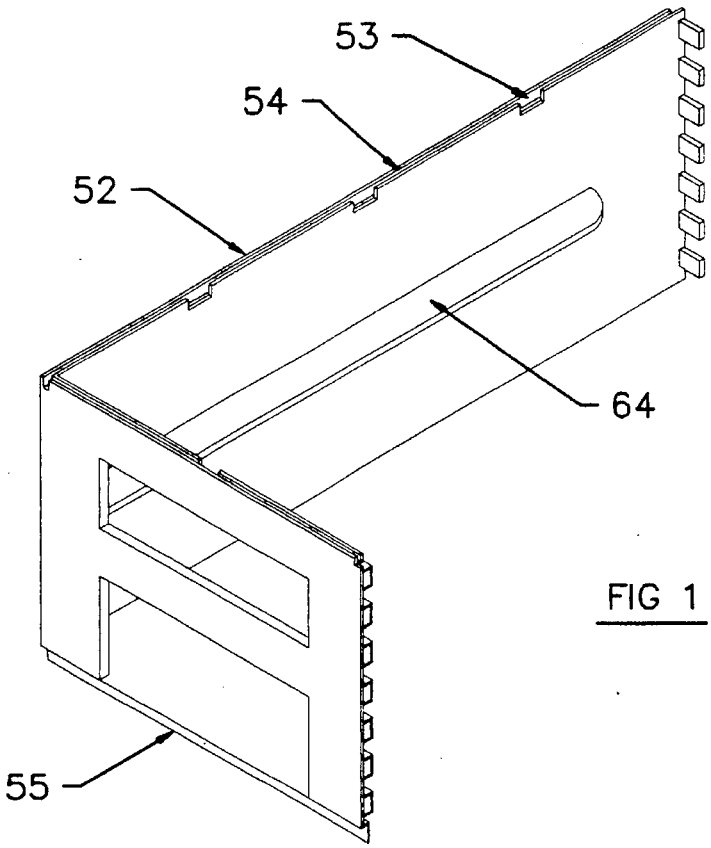
FIG. 1 is an isometric view of a building element according to the invention.
Figure 2:
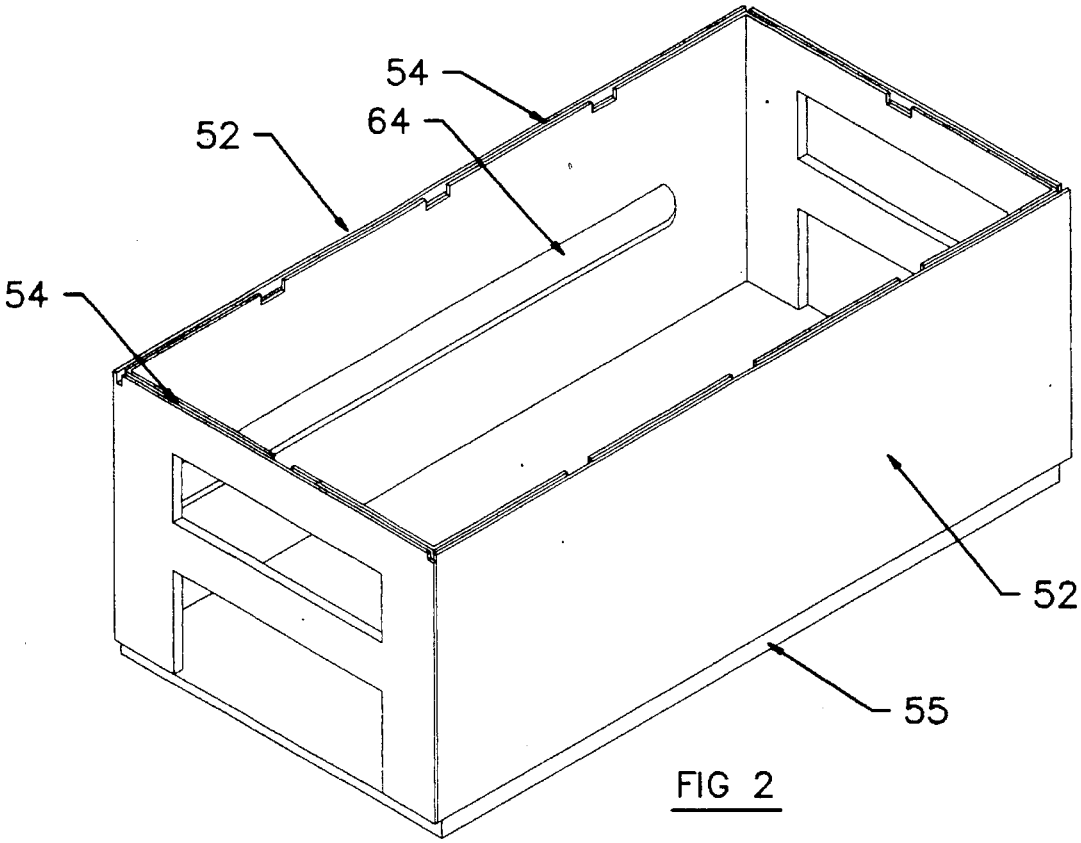
FIG. 2 is a similar view of two elements joined together.
Figure 3:
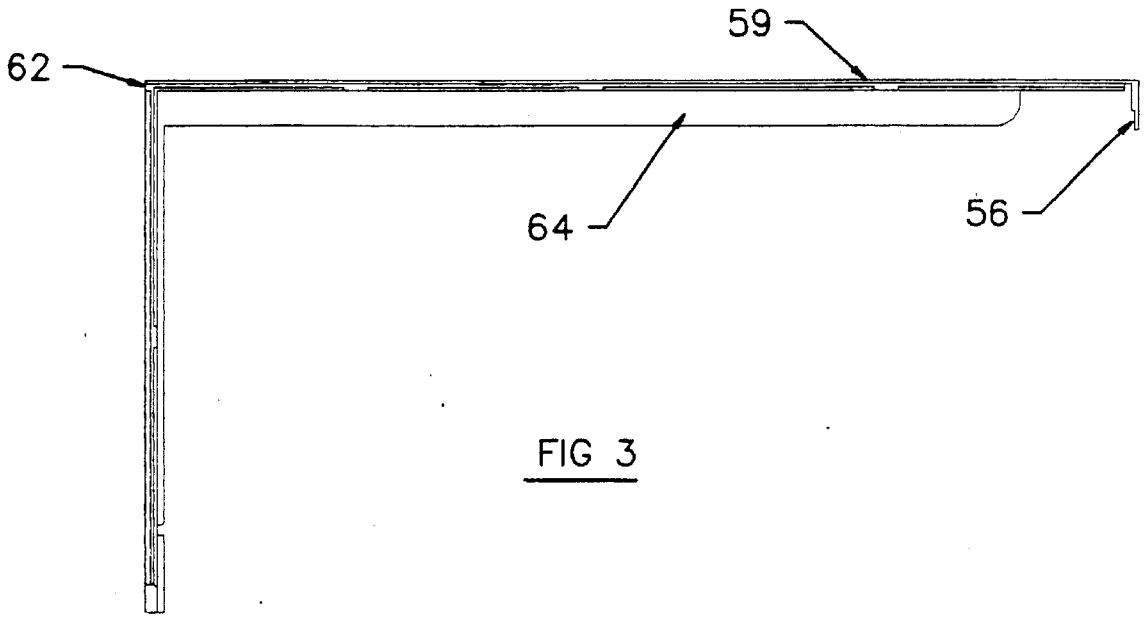
FIG. 3 is a plan view of the element.
Figure 4:
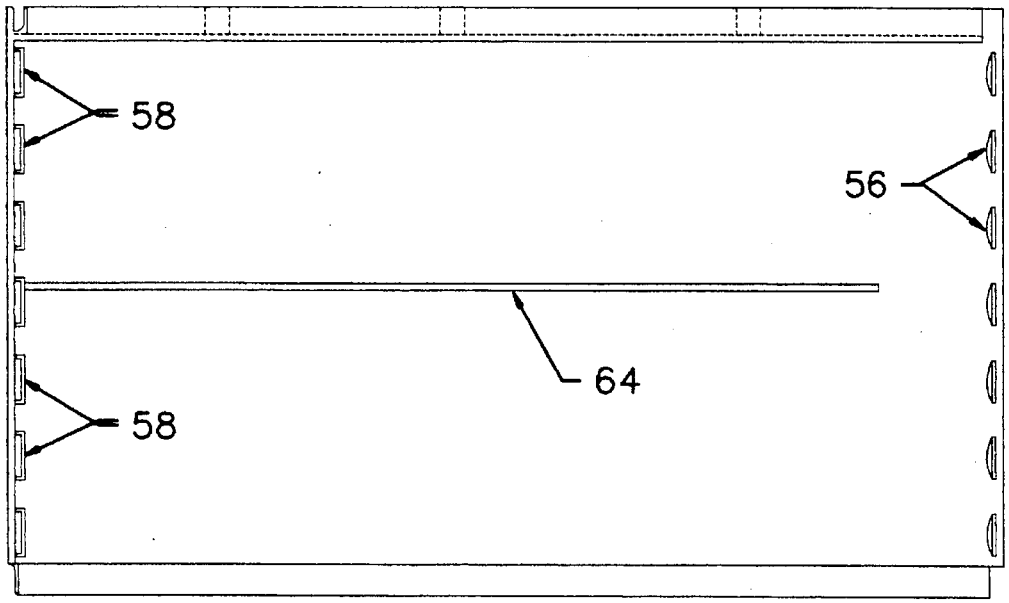
FIG. 4 is a front view.
Figure 5:
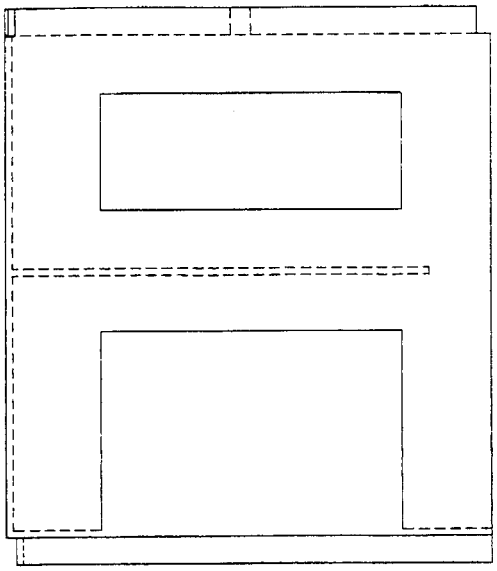
FIG. 5 is an end view.
Figure 6:
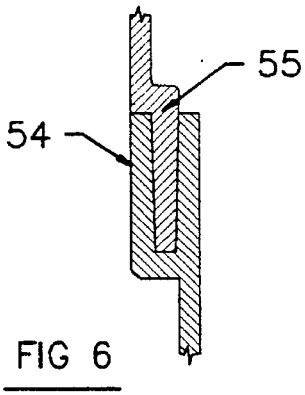
FIG. 6 is a sectional view of the peripheral channel and corresponding male formation.
Figure 7:
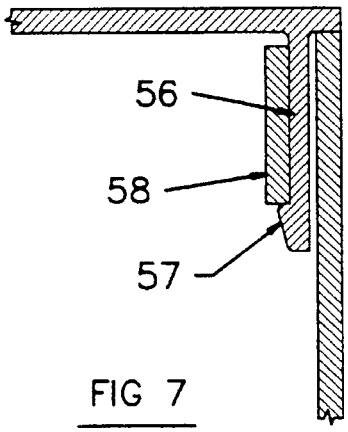
FIG. 7 is a sectional view of the male and female interengaging formations between adjacent corners of two building elements.

In the drawings a building element includes identical halves 52, which include a peripheral channel 54 which, in the assembled element is continuous save for the corners which are recessed to receive the end of an adjacent building element. The channel tapers inwardly as shown in FIG. 6. The opposite end of the element includes a continuous male formation 55 which is complementally tapered.

The halves are joined by means of a series of tongues or spades 56 which are male elements having hooked ends 57 the hook formations being of straight sided configuration as shown. These tongues engage in recesses or notches 58 to complete a building element according to the invention.

Figure 9:
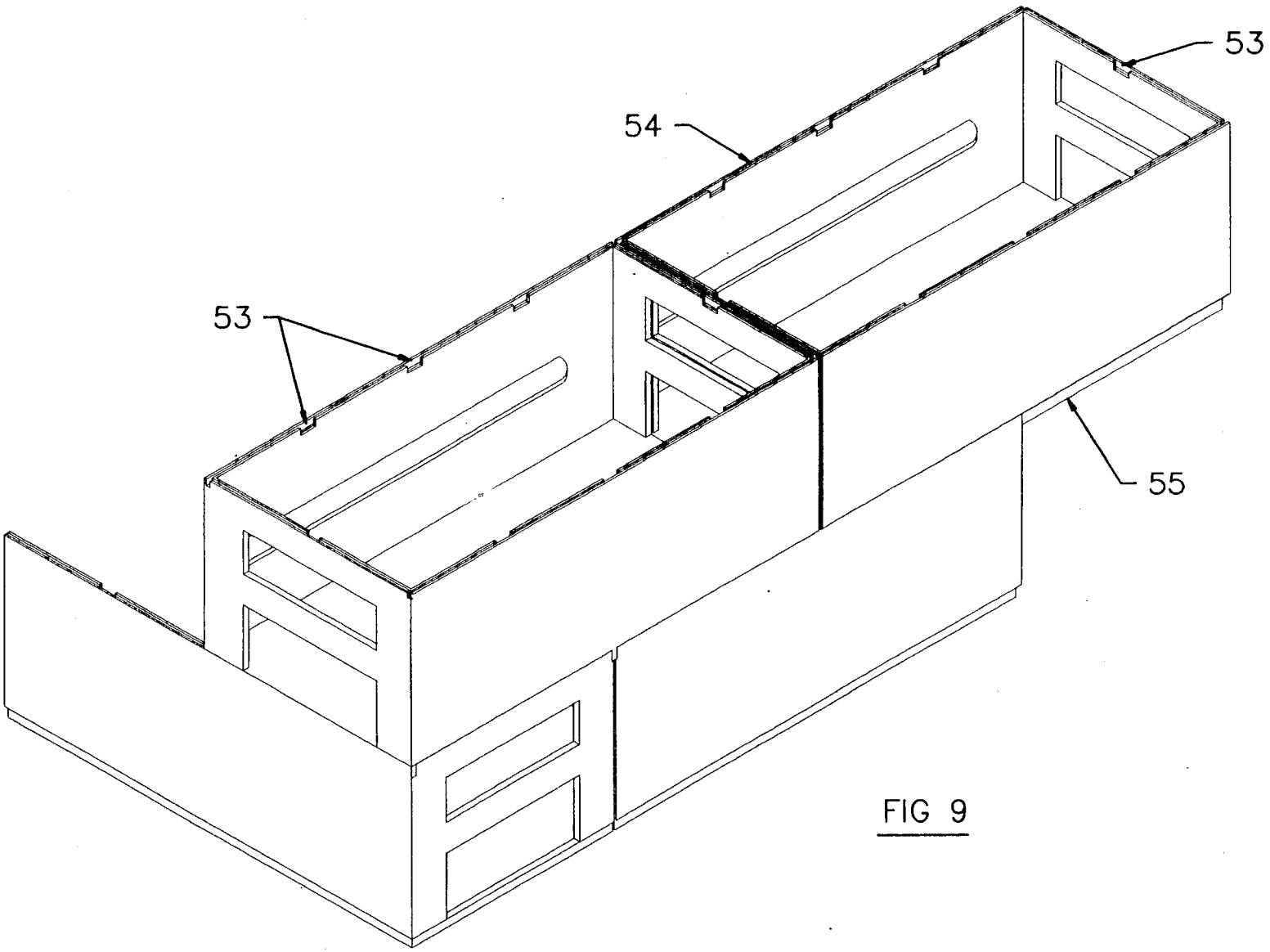
FIG. 9 is an isometric view of an assembly of stacked building elements according to the invention.

The channels 54 have a continuous outer wall 59 except for the corner recesses 62. The inner wall has castellations 53 at three predetermined locations therealong. This facilitates the staggered stacking of building elements such that a quarter-brick or half-brick formation may be achieved as shown in FIG. 9. If it is desired to locate an adjacent building element at an angle (preferably a right angle) a portion of the outer wall is removed at the desired location opposite the castellation to receive the edge of the adjacent building element thereacross. The elements include stiffening ribs 64 designed to prevent the sides from bulging.

Figure 8:
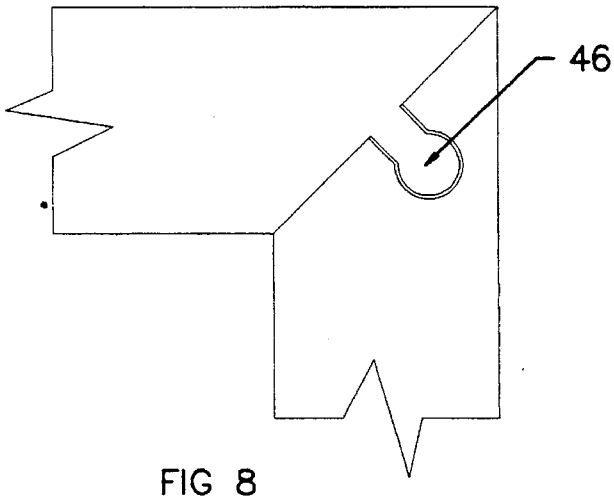
FIG. 8 is an isometric view of an alternative form of interengaging formation.

In FIG. 8, the two building elements are joined together by a ball and socket joint 46.

FIG. 9 illustrates the stacking of the elements in staggered formation, the castellations 53 permitting a half element overlap as shown as well as a quarter overlap (not shown).

Figure 10:
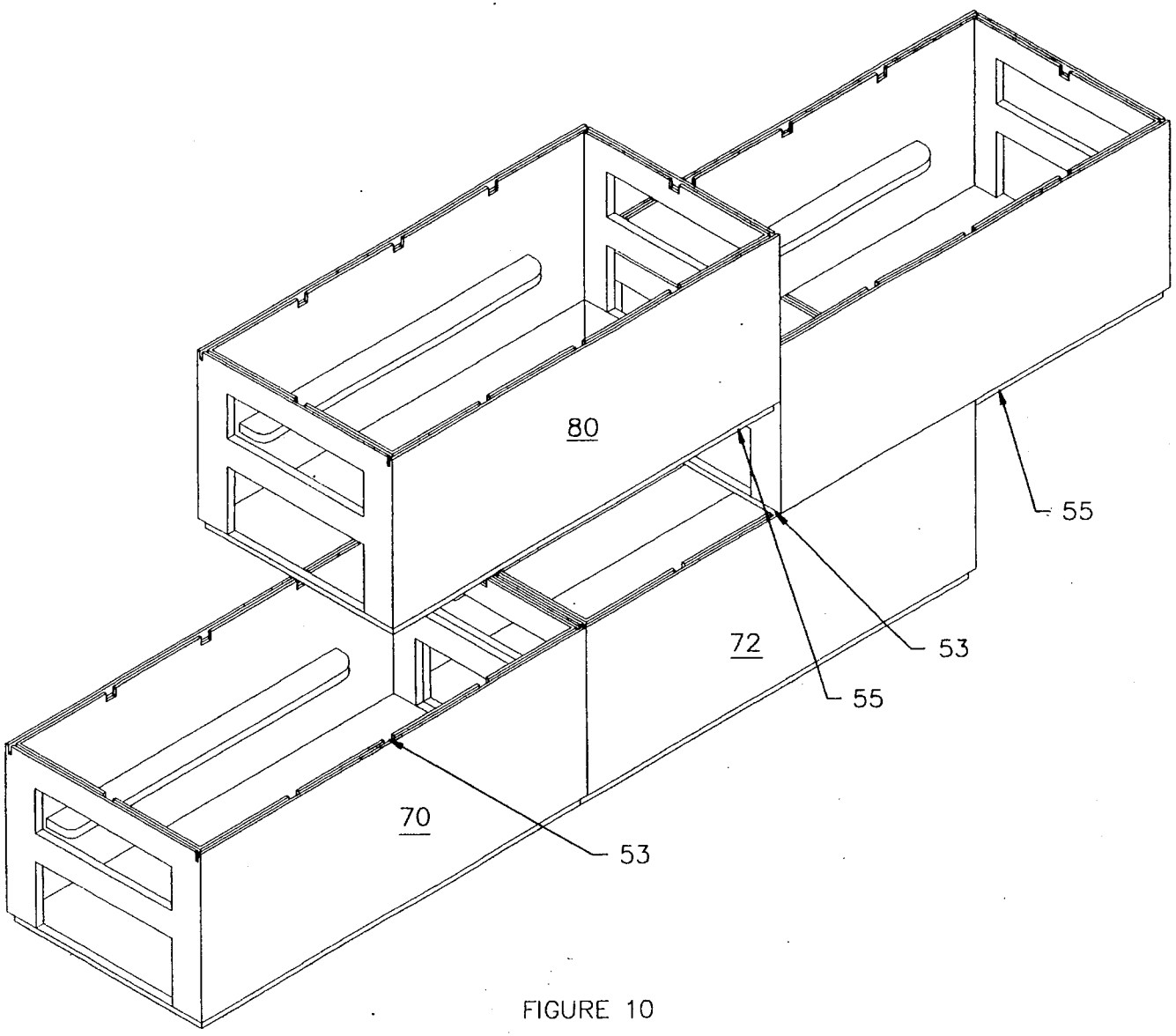
FIG. 10 is an exploded isometric view of an assembly of building elements in staggered stacked formation.

Turning now to FIG. 10, building element 80 is stacked on top of elements 70 and 72 such that it overlaps half of each of the elements below it. The peripheral male formation 55 of element 80 fits into the peripheral channels of elements 70 and 72. The corners of element 80 fit into the castellations 53 such that there is close contact between the formation 55 and the inner sides of the castellations.

In this position elements 70 and 72 cannot slide in either direction and therefore element 80 is effectively bonding them together, adding to the overall strength of the stack.

I claim:

1. A building element comprising a pair of right-angled elements interengaged to form a topless and bottomless box, upper or lower edges of the box including a channel formation adapted to receive the periphery of an adjacent element in stacking relationship, an outer wall of the channel being continuous and uninterrupted and an inner wall of the channel including a series of castellations opposite said continuous outer wall and adapted to receive the peripheries of building elements.

2. A building element according to claim 1, in which the right angled elements are L-shaped.

3. A building element according to claim 1, in which the channel formation includes recesses therein.

4. A building element according to claim 1, in which the right angled elements include formations at the ends thereof slidable into and out of engagement in a horizontal plane.

5. A building element according to claim 4, in which the formations comprise flexible male elements having hooked free ends engageable in female elements including formations adapted to receive and retain the hooked ends.

6. A building element according to claim 5, in which the male elements are tongues with straight sides and hooked ends providing shoulders for engaging in complementary formations in the female element.

7. A building element according to claim 1, which includes longitudinally disposed horizontal reinforcing ribs.

8. A building element according to claim 7, in which the ribs comprise inwardly extending flanges located around the inner dimensions of the box.

9. A building element according to claim 1, which includes cutout formations adapted to provide deformability.

* * * * *